United States Patent [19]

Podell et al.

[11] 3,980,972

[45] Sept. 14, 1976

[54] PROXIMITY COUPLER

[75] Inventors: Allen F. Podell, Los Altos, Calif.; Leo Young, Bethesda, Md.; Arthur Karp, Palo Alto; Donald R. Chambers, Menlo Park, both of Calif.

[73] Assignee: Stanford Research Institute, Menlo Park, Calif.

[22] Filed: July 14, 1975

[21] Appl. No.: 595,396

[52] U.S. Cl. ..... 333/10; 333/84 M

[51] Int. Cl.[2] ..... H01P 5/18

[58] Field of Search ..... 333/10, 84 M

[56] References Cited

UNITED STATES PATENTS 3,629,733 12/1971 Podell ..... 333/10

3,904,991 9/1975 Ishii et al. ..... 333/10

*Primary Examiner*—Paul L. Gensler

*Attorney, Agent, or Firm*—Lindenberg, Freilich, Wasserman, Rosen & Fernandez

[57] ABSTRACT

A proximity coupler is provided for high frequency circuits wherein conductors are deposited on a substrate in the shape of a hollow dumbbell intersected by an X. Coupling is provided primarily across saw-toothed shaped gaps in the dumbbell center section and secondarily across a gap formed by spaced parallel connectors in said center section. The parallel conductors have phase delaying loops at opposite ends, and the resulting coupling characteristics of the proximity coupler can be modified by dimensional changes of the loops.

5 Claims, 4 Drawing Figures

Fig. 1
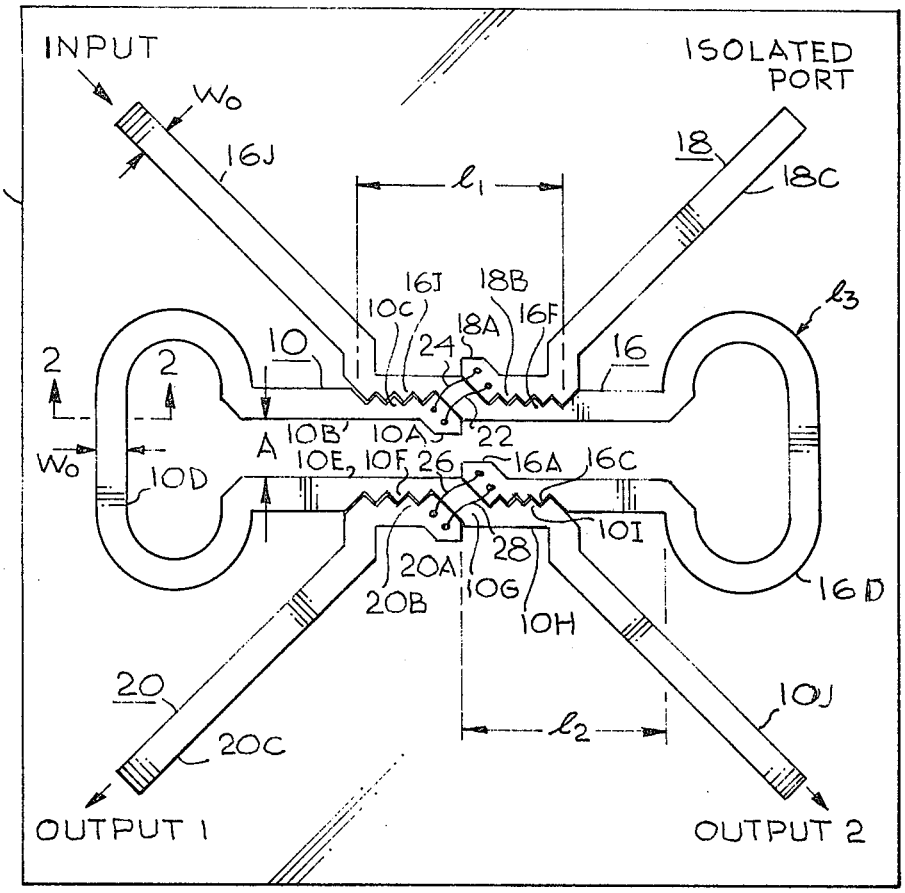
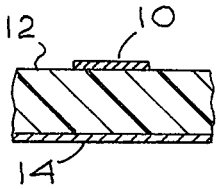
Fig. 2
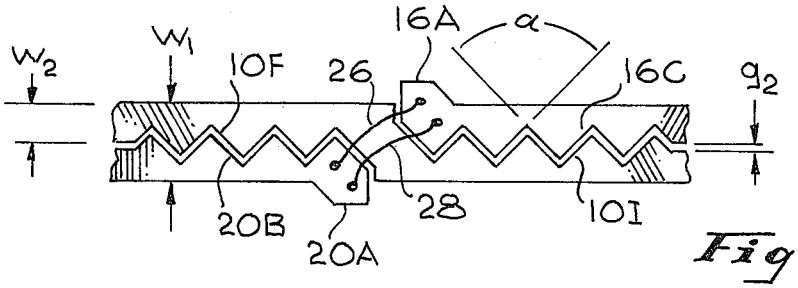
Fig. 3
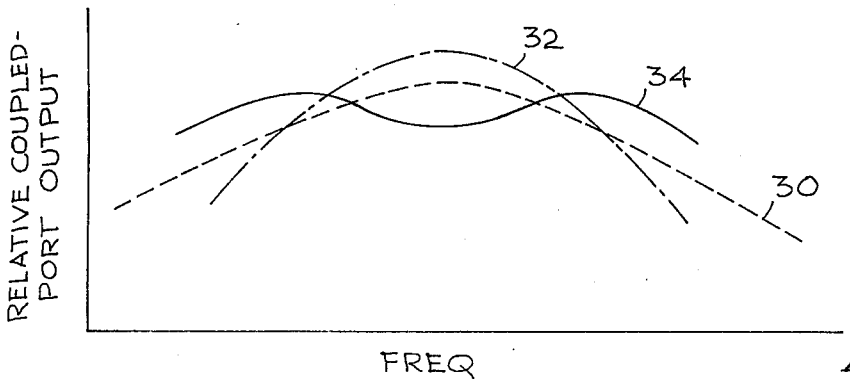
Fig. 4

PROXIMITY COUPLER

BACKGROUND OF THE INVENTION

This invention relates to directional coupling circuits used in microwave apparatus and more particularly to improvements therein.

Broad band 3-dB directional couplers have many applications in microwave receivers and power sources for communications and radar. Couplers with better band-widths than those available until now would improve the usefulness of the equipment in which they are used.

OBJECT AND SUMMARY OF THE INVENTION

It is an object of this invention to provide a microwave coupler that provides broader band-width than heretofore available.

Another object of this invention is the provision of a novel, useful, and improved microwave coupler.

The foregoing and other objects of the invention are achieved in a microwave coupler comprising a printed circuit deposited on a substrate having the overall configuration of a hollow dumbbell with an "X" intersecting the central portion. The dumbbell shape with one half of the X is made up by two conductors, one starting at one side of the central portion of the dumbbell, extending from there to, and around a loop, across the other side of the central portion of the dumbbell and then angling away to form one of the four arms of the X. A second conductor forms the other half of the dumbbell and another arm of the X, extending in the opposite direction. Two further conductors extend from opposite sides of the central portion of the dumbbell to form the two remaining arms of the X. These two conductors extend for a distance along the central portion of the dumbbell where their sides opposing the central portion are sawtooth shaped and are spaced from sawtooth shaped sides of the conductors forming the dumbbell.

The central portion of the coupler comprises two substantially parallel and spaced apart conductors whose opposite inside surfaces form one gap. The loops provided at opposite ends of the two parallel conductors connect with these opposite ends and provide a phase delay for the coupler circuit. The two conductors forming the outside sides of the dumbbell together with the two conductors completing the X are shaped and spaced at the region of the center of the dumbbell to provide sawtooth shaped gaps which form the primary gaps of the coupler.

The novel features of the invention are set forth with particularity in the appended claims. The invention will best be understood from the following description when read in conjunction with the accompanying drawings.

BRIEF DESCRIPTION OF THE DRAWINGS

FIG. 1 is a plan view of a coupler in accordance with this invention.

FIG. 2 is a cross sectional view along the lines 2—2 illustrating the appearance of a portion of the invention in cross section.

FIG. 3 is an enlarged view of the sawtooth gap which is part of the invention.

FIG. 4 is a graph illustrating typical coupling characteristics of the embodiment of the invention.

DESCRIPTION OF THE PREFERRED EMBODIMENTS

As may be seen in FIG. 1, a coupler, in accordance with this invention, comprises printed circuit conductors deposited on a substrate. As illustrated by the cross sectional view of FIG. 2, the printed circuit conductor 10 is deposited on the one surface of an insulating substrate 12, and on the opposite surface there is deposited a conductive "ground" film 14.

The coupler, in accordance with this invention, may be made of four conductors respectively 10, 18, 20, and 16. Effectively conductors are formed in the shape of the outline of a hollow dumbbell which is intersected by an X. Serrated or sawtoothed gaps are established in the center region of the dumbbell where the conductors are parallel to one another and extend between the two outside loops. Considering the center region of the dumbbell shaped conductors, the conductor 10 commences at a point 10A at the center and extends from the commencement point with an inside surface 10B which is straight and a serrated outside surface 10C, to a phase delay loop 10D. The loop extends until it joins another section of the conductor which has an inside straight surface 10E, which is parallel to and spaced from the surface 10B. The outside surface of the loop section 10E has a sawtoothed or serrated portion 10F.

The conductor 10 then continues through an inside to outside transition region 10G, following which it extends with an outside straight surface 10H, and an inside sawtoothed surface 10I. At the termination of the sawtooth, the conductor has a portion 10J, which extends away from the dumbbell form at approximately a 45° angle.

A second conductor, 16, has reversed but substantially identically shaped sections and inside and outside shapes as the conductor 10. Its sections therefore bear lettering similar to that used for the conductor 10 sections. The conductor 10 may be considered as a left-handed part of the dumbbell, and the conductor 16 may be considered as the right-handed part of the dumbbell. Opposite the sawtooth region 10C of the conductor 10, is an opposite and complimentary sawtooth region 16I. Opposite the sawtooth region 10I of the conductor 10, the conductor 16 provides an opposite and complimentary sawtooth region, 16C.

Two other conductors, are provided, respectively 18 and 20. Conductor 18 has an end portion 18A which is spaced from the region of conductor 16 which transitions from the sawtooth region 16F to the sawtooth region 16I. Conductor 18, then, also has a sawtooth portion 18B which is spaced opposite the sawtooth region 16F of conductor 16. Conductor 18 then extends at a substantially 45° angle away from the dumbbell to provide another circuit terminal.

Conductor 20 similarly, has a starting portion 20A which is spaced opposite the region at which conductor 10 transitions between the sawtooth regions 10F and 10I. Conductor 20 then also has a sawtooth region 20B which is spaced opposite the sawtooth surface 10F. Conductor 20 then has a section 20C which extends away from the dumbbell shaped coupler at substantially a 45° angle.

FIG. 3 is an enlarged sectional view of one of the sawtoothed regions shown in FIG. 1 and bear the same reference numerals as are used in FIG. 1. It is shown to better illustrate the details of the sawtooth gaps.

Those skilled in the art will appreciate the fact that the coupler shown herein is symmetrical and the inputs and the outputs may be reversed without effectively changing the operating behavior of the coupler. The conductor portion 16J may be used as an input to the coupler, with one half power outputs being derived from conductor portions 20C and 10J. Conductor portion 18C is an isolated port.

The two principal couplings of the directional coupler occur across the sawtooth gaps having an effective interaction length $l_1$, which is shown in FIG. 1. The length $l_1$, is adjusted to be one quarter the mid-band wave length for an even mode of propagation. To make the coupling characteristic symmetrical about the mid-band frequency, jumper connections respectively 22, 24, 26, and 28, are used at the center of the coupler structure to maintain electrical symmetry of the overall coupler and to provide the proper interconnections between the two individual coupler conductors respectively 10 and 18, and 16 and 20, in a way that is typical for tandem or cascade connected couplers.

The unique feature of the proximity coupler is auxiliary coupling that obtains across the gap of width A. This coupling is largely, but not entirely, due to the interaction between the innermost two of the four parallel conductor strips of the central cross section. Correct performance requires that the lengths $l_1$ and $l_2$ be approximately one quarter wave length long at mid-band. The loop length $l_3$, which comprises a delay line, is one half wave length long also at mid-band.

By way of example, and not to serve as a limitation upon the invention, for a mid-band frequency of 510MHZ, $l_1$ is made equal to $l_2$ which is equal to 2 inches. The width of the conductors 10 and 16, equals $w_0$, equals 0.25 inches. The spacing between the two parallel sides of the conductors forming the center of the dumbbell, A equals 0.5 inches. The diameter of each of the bridge wires, 24 – 28, equals 0.025 inches.

Referring now to FIG. 2, the thickness of the dielectric which was used is 0.25 inches, and the relative dielectric constant was equal to 10.

Referring to FIG. 3, it may be seen that the sawtooth angle selected is, $\alpha = 90°$. The gap, g2, between the sawtooth sections was selected at 0.022 inches. The dimension $W_1$ was selected as 0.287 inches. The width $W_2$, was selected as 0.183 inches.

In order to adapt the coupler for other frequencies, the design shown in the drawings and described herein, may be scaled to any frequency by adjusting all the dimensions which have been given above according to the following ratio, $X' = X.510/f'$, where $X'$ is the new dimension; X is the dimension given in the illustration above, and $f'$ is the new frequency in MHZ.

FIG. 4 illustrates a comparison between the coupling characteristics of a conventional coupler represented by the dotted line curve 30, and two possible configurations of the coupler in accordance with this invention, represented by the dash-dot line 32 and the solid line 34. The proximity effect gives rise to an equivalent coupling with an independent phase relationship with respect to the principal couplings. Because of the independent nature of the proximity and principal couplings, changes in the lengths of the interconnecting lines (loop length $l_3$, in FIG. 1) between the principal coupling changes the overall characteristics. Relatively short lengths of $l_3$ result in coupling characteristics as shown by the curve 32, indicating that the proximity coupling and the principal couplings aid at band center and are in opposition at the band edges. Increasing the loop length to one half wave length at mid-band reverses the relative phase relationships and results in an overall coupling characteristic as represented by the curve 34. This results in a better band width capability than can be achieved by conventional couplers.

There has accordingly been described and shown herein above a novel and improved coupler for microwave frequencies.

The embodiments of the invention in which an exclusive property or privilege is claimed are defined as follows:

1. A microwave frequency coupler circuit comprising a dielectric substrate, a plurality of conductor means deposited on one surface of said substrate in the form of the cross section of a hollow dumbbell intersected at its center portion by an X, said plurality of conductor means including a first and a second conductor respectively forming two oppositely extending arms of said X and left and right halves of said dumbbell, said first and second conductors coextending spaced apart for a predetermined distance at said center portion for establishing a first coupling region therebetween, and said plurality of conductor means including a third and fourth conductor respectively forming the remaining two oppositely extending arms of said X and respectively being coextensive with and being spaced apart from said respective first and second conductors at said central portion over a predetermined distance where said first and second conductors are not coextensive, for establishing a second coupling region therebetween.

2. A microwave frequency coupler circuit as recited in claim 1 wherein said respective first and second conductors each has a sawtooth shape over the predetermined distance of said first coupling region to form therebetween a sawtooth shaped gap and said respective first, second, third and fourth conductors each has a sawtooth shape over the predetermined distance of said second coupling region to form therebetween sawtooth shaped gaps.

3. A microwave frequency coupler circuit as recited in claim 1 wherein first jumper connecting means are connected between the ends of said first and third conductors at said central portion, and second jumper connecting means are connected between the ends of said second and fourth conductors at said central portion.

4. A microwave coupler, comprising a substrate, a first conductor means deposited on one side of said substrate, said first conductor means having the form of an open, substantially elliptically shaped loop with two opposite first conductors extending therefrom, one of said first conductors being shorter than the other and extending parallel to the other for substantially all of its length and ending at a central location, said longer first conductor diverging outwardly past said central location, a second conductor means deposited on said one side of said substrate, said second conductor means having the form of an open, substantially elliptically shaped loop with its opening facing the loop opening formed by said first conductor means, the loop of said second conductor means further having two opposite second conductors extending from its ends to the opposite first conductors of said first conductor means, one of said second conductors being shorter than the other and extending parallel to the other for substantially all of its length ending at said central location, said longer second conductor diverging outwardly past said central location, said shorter first conductor having a sawtoothed edge shape for a portion of its length near its end, said longer second conductor having the portion of its edge adjacent said shorter first conductor sawtoothed edge spaced therefrom and forming a sawtoothed gap therewith, said shorter second conductor having a sawtoothed edge shape for a portion of its length near its end, said longer first conductor having the portion of its edge adjacent said shorter second conductor sawtoothed edge spaced therefrom and shaped to form a sawtoothed gap therewith, third conductor means having the edge of one end spaced from and forming a sawtoothed gap with one edge of a portion of said longer first conductor adjacent said central location, and fourth conductor means having the edge of one end spaced from and forming a sawtoothed gap with one edge of a portion of said longer second conductor adjacent said central location.

5. A microwave coupler as recited in claim 4 wherein there is included a first conductive jumper means connected between said shorter first conductor and said fourth conductor, and a second conductive jumper means connected between said shorter second conductor and said third conductor.

* * * * *